US011549712B2

(12) United States Patent
Cha et al.

(10) Patent No.: US 11,549,712 B2
(45) Date of Patent: Jan. 10, 2023

(54) AIR-CONDITIONER REPEATER, AIR-CONDITIONER SYSTEM AND A CONTROL METHOD THEREOF

(71) Applicant: Samsung Electronics Co., Ltd., Suwon-si (KR)

(72) Inventors: Jae-hoon Cha, Suwon-si (KR); O-do Ryu, Hwaseong-si (KR); Su-ho Jo, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 76 days.

(21) Appl. No.: 16/629,804

(22) PCT Filed: Aug. 17, 2018

(86) PCT No.: PCT/KR2018/009439
§ 371 (c)(1),
(2) Date: Jan. 9, 2020

(87) PCT Pub. No.: WO2019/039795
PCT Pub. Date: Feb. 28, 2019

(65) Prior Publication Data

US 2020/0232672 A1 Jul. 23, 2020

(30) Foreign Application Priority Data

Aug. 24, 2017 (KR) ..... 10-2017-0107465

(51) Int. Cl.
*F24F 11/56* (2018.01)
*F24F 11/38* (2018.01)
(Continued)

(52) U.S. Cl.
CPC ..... *F24F 11/56* (2018.01); *F24F 11/38* (2018.01); *F24F 11/61* (2018.01); *F24F 11/88* (2018.01)

(58) Field of Classification Search
CPC .. F24F 11/38; F24F 11/56; F24F 11/88; F24F 11/61; H04W 52/44
See application file for complete search history.

(56) References Cited

U.S. PATENT DOCUMENTS 8,249,504 B2 8/2012 Fujii
9,066,228 B2 6/2015 Fujii
(Continued)

FOREIGN PATENT DOCUMENTS

EP 2 034 464 A2 3/2009
EP 2 782 359 A1 9/2014
(Continued)

OTHER PUBLICATIONS

European Search Report dated May 20, 2020; European Appln. No. 18848187.3-1215 / 3635299 PCT/KR2018009439.
(Continued)

*Primary Examiner* — Mohammad Ali
*Assistant Examiner* — Vincent W Chang
(74) *Attorney, Agent, or Firm* — Jefferson IP Law, LLP

(57) ABSTRACT

An air conditioner controlling method of an air conditioner repeater is provided. The method includes based on a remote controller being connected to the air conditioner repeater via a cable, generating pairing information, transferring the generated pairing information to the remote controller via the cable, based on a response message for the pairing information being received from the remote controller via the cable, performing pairing with the remote controller, and based on the wired connection with the remote controller is released and an air conditioner and the air conditioner repeater are connected via a cable, transferring a wireless signal received from the remote controller in a Bluetooth method to the air conditioner.

14 Claims, 6 Drawing Sheets

(51) Int. Cl.
*F24F 11/88* (2018.01)
*F24F 11/61* (2018.01)

(56) References Cited

U.S. PATENT DOCUMENTS

| | | | | |
|---|---|---|---|---|
| 9,294,899 | B2 | 3/2016 | Lee et al. | |
| 9,542,678 | B1 * | 1/2017 | Glashan | G06Q 20/325 |
| 9,883,392 | B2 | 1/2018 | Fujii | |
| 10,271,211 | B2 | 4/2019 | Fujii | |
| 10,536,856 | B2 | 1/2020 | Fujii | |
| 2006/0090483 | A1 | 5/2006 | Kim et al. | |
| 2006/0111097 | A1 | 5/2006 | Fujii | |
| 2008/0057868 | A1 | 3/2008 | Chang | |
| 2009/0178086 | A1 | 7/2009 | Unger | |
| 2011/0028094 | A1 | 2/2011 | Masuda | |
| 2012/0021766 | A1 * | 1/2012 | Masuda | H04W 4/02 455/456.1 |
| 2012/0178421 | A1 | 7/2012 | Fujii | |
| 2014/0324231 | A1 * | 10/2014 | Kawai | G08C 17/02 700/276 |
| 2015/0105917 | A1 * | 4/2015 | Sasaki | F25D 29/00 700/276 |
| 2015/0249923 | A1 * | 9/2015 | Fujii | H04W 12/50 726/7 |
| 2016/0202711 | A1 * | 7/2016 | Lazar | G05D 23/19 236/1 C |
| 2016/0291615 | A1 * | 10/2016 | Zakaria | F24F 13/082 |
| 2017/0030605 | A1 * | 2/2017 | Heller | F24F 11/30 |
| 2017/0038087 | A1 | 2/2017 | Nabeshima et al. | |
| 2018/0109949 | A1 | 4/2018 | Fujii | |
| 2018/0356115 | A1 * | 12/2018 | Koizumi | F24F 11/56 |
| 2019/0182667 | A1 | 6/2019 | Fujii | |
| 2021/0111871 | A1 * | 4/2021 | Chin | H04L 9/0869 |

FOREIGN PATENT DOCUMENTS

| | | | |
|---|---|---|---|
| JP | H06-261371 | A | 9/1994 |
| JP | 2006-174423 | A | 6/2006 |
| JP | 2011-034310 | A | 2/2011 |
| JP | 2013-104645 | A | 5/2013 |
| JP | 2013-104646 | A | 5/2013 |
| JP | 2015-121392 | A | 7/2015 |
| JP | 2015-183936 | A | 10/2015 |
| KR | 10-2006-0038264 | A | 5/2006 |
| KR | 10-0817594 | B1 | 3/2008 |
| KR | 10-0836818 | B1 | 6/2008 |
| KR | 10-2010-0055741 | A | 5/2010 |
| KR | 10-2011-0031705 | A | 3/2011 |
| KR | 10-1272357 | B1 | 6/2013 |
| KR | 10-2014-0046152 | A | 4/2014 |
| WO | 2009/085482 | A1 | 7/2009 |
| WO | 2011/034302 | A2 | 3/2011 |

OTHER PUBLICATIONS

Korean Office Action dated Sep. 16, 2021, issued in Korean Patent Application No. 10-2017-0107465.

* cited by examiner

[Fig. 1]
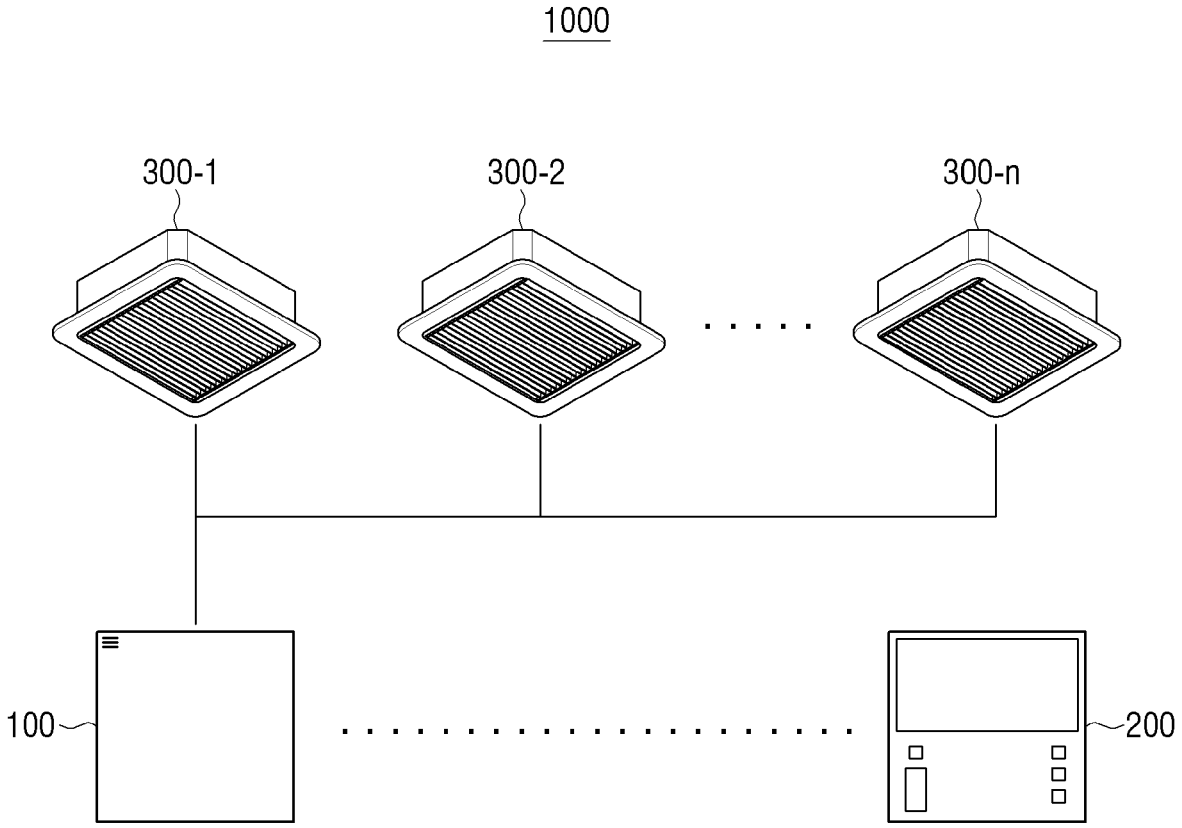
[Fig. 2]
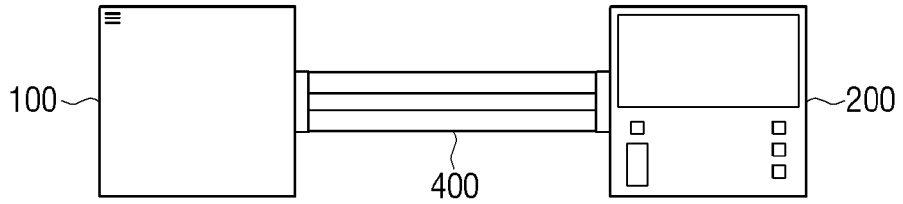
[Fig. 3]
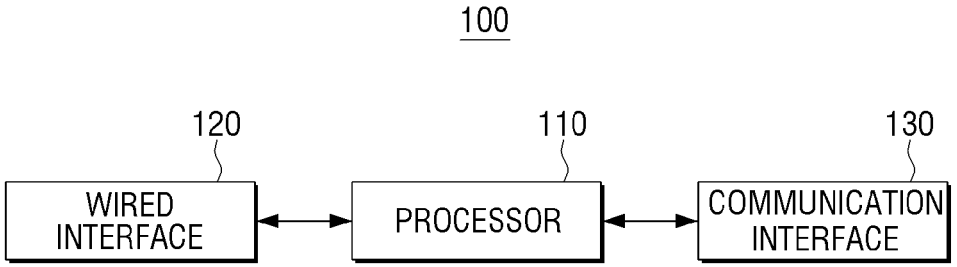

[Fig. 4]
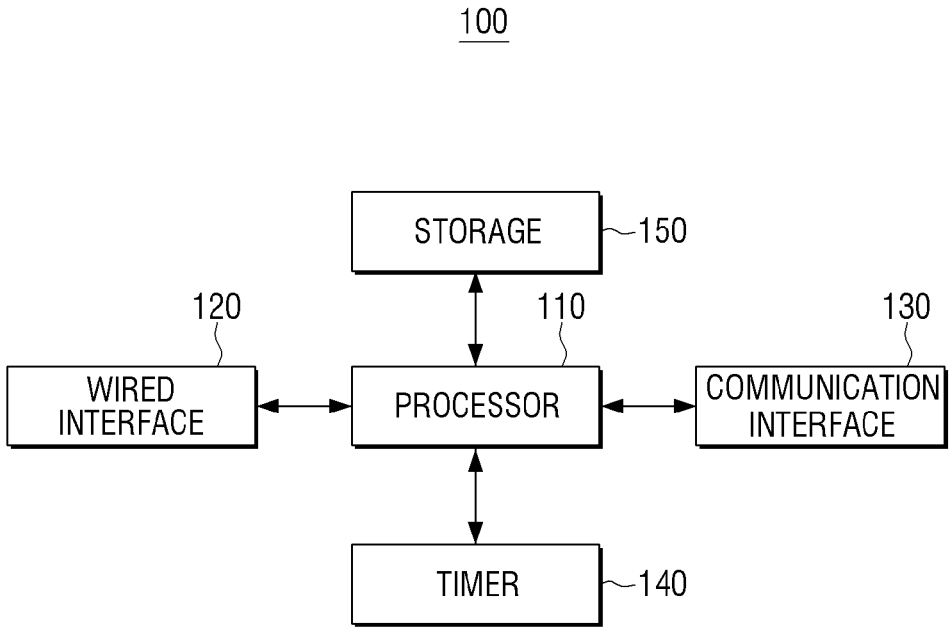
[Fig. 5]
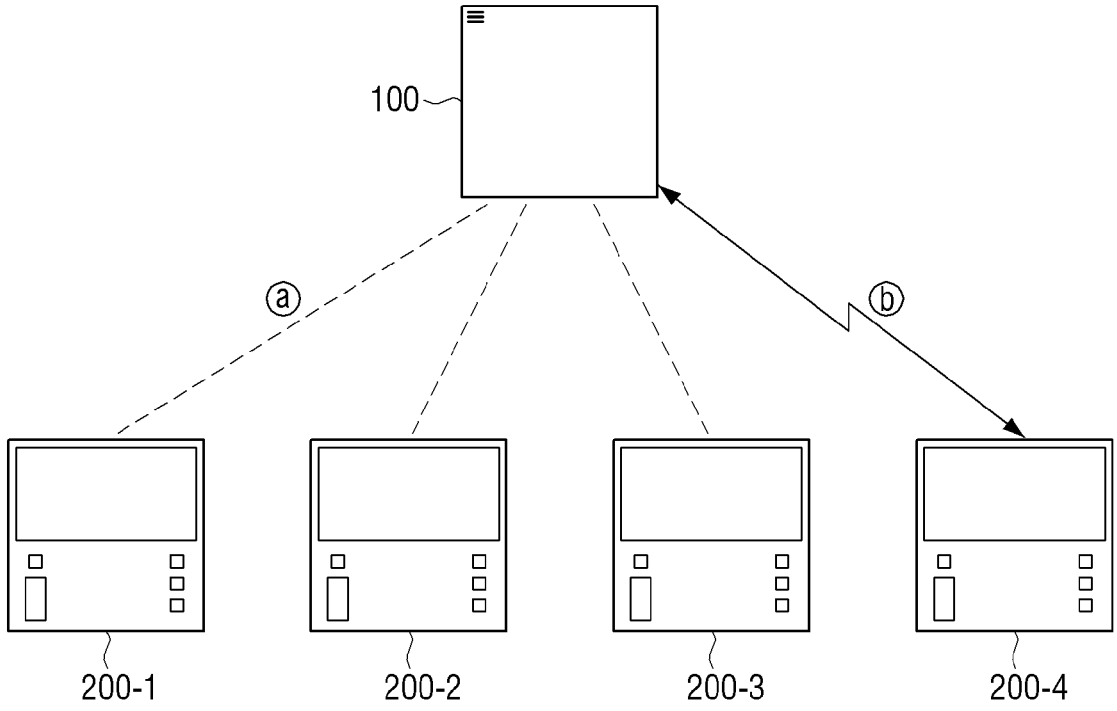

[Fig. 6]
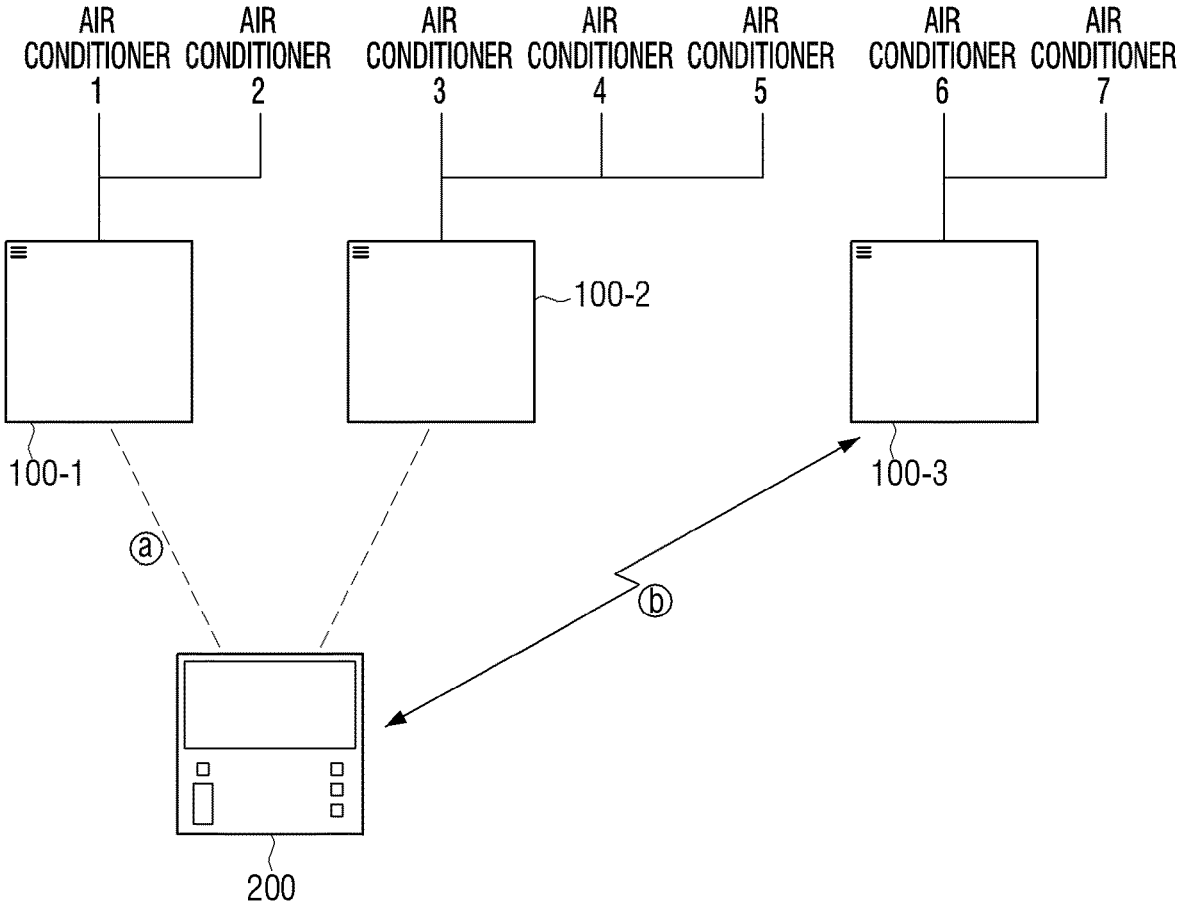
[Fig. 7]
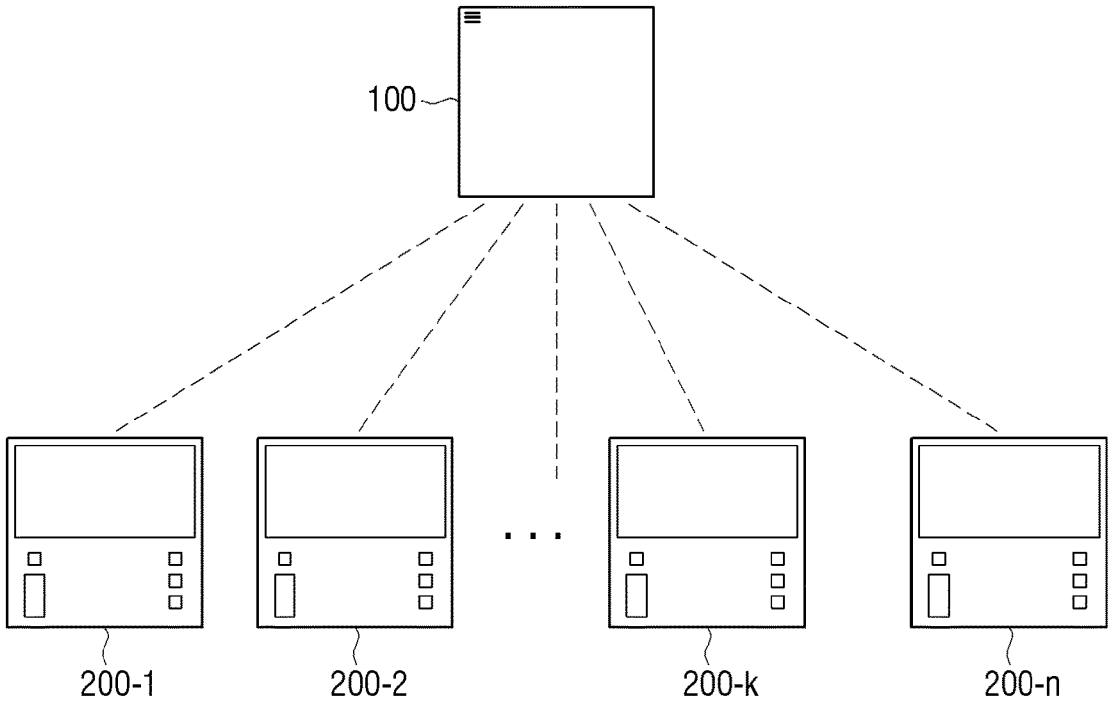

[Fig. 8]
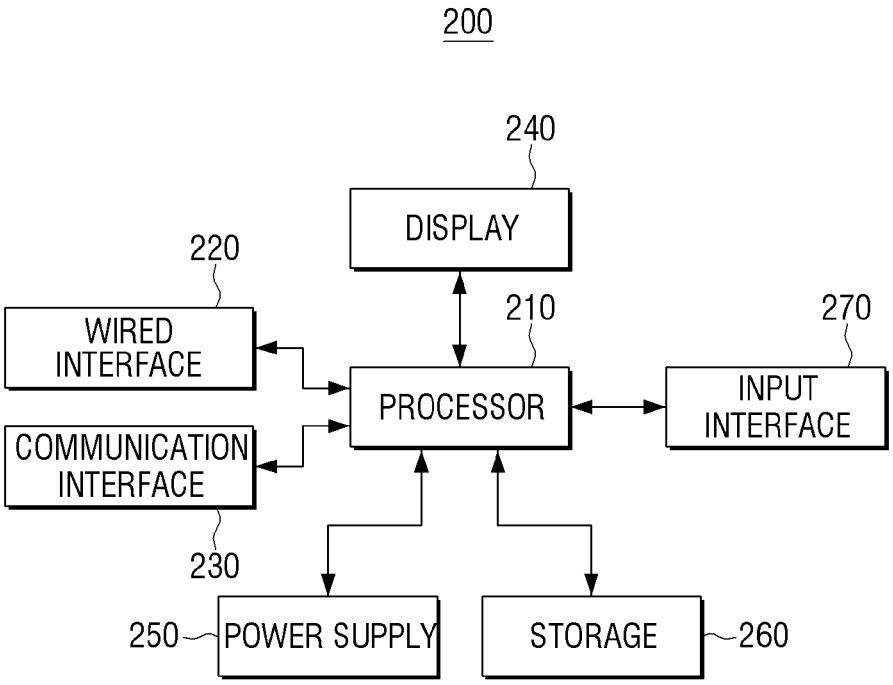

[Fig. 9]
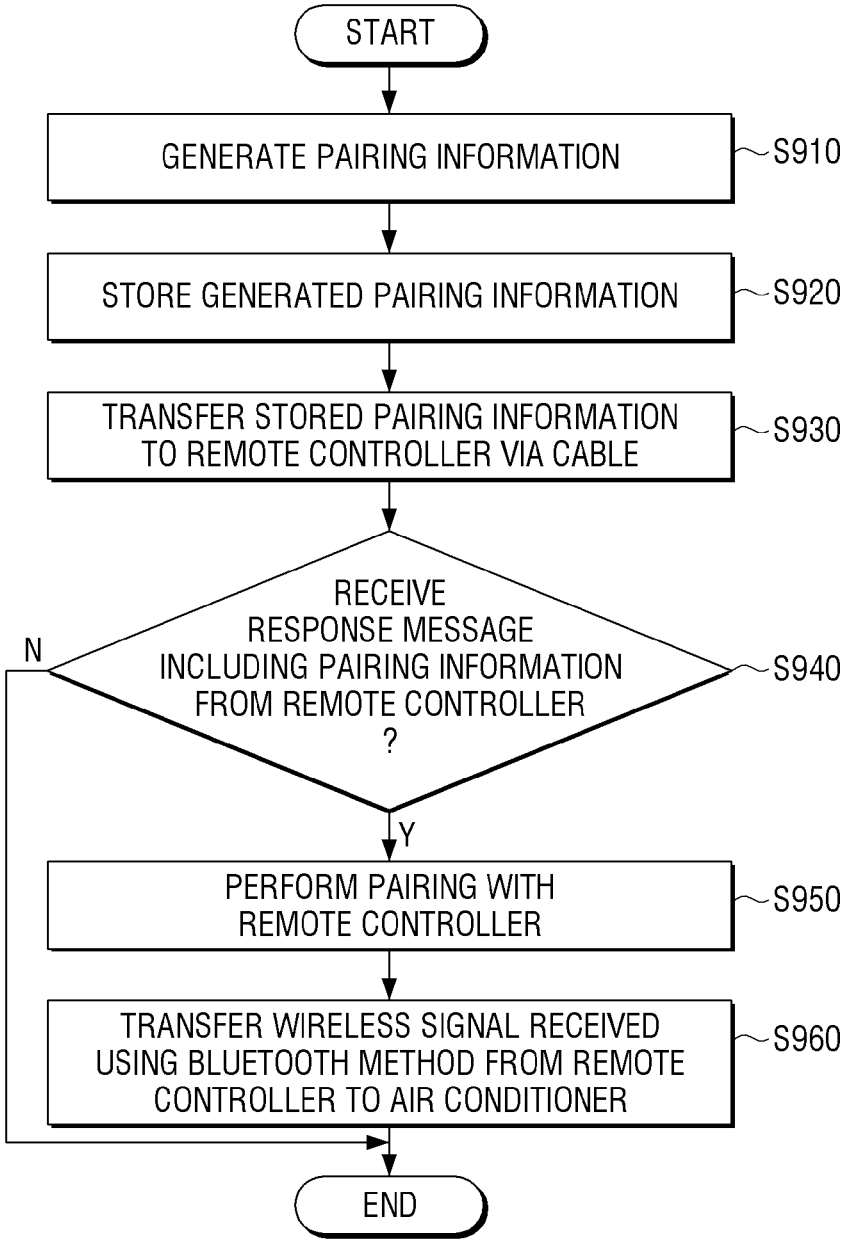

[Fig. 10]
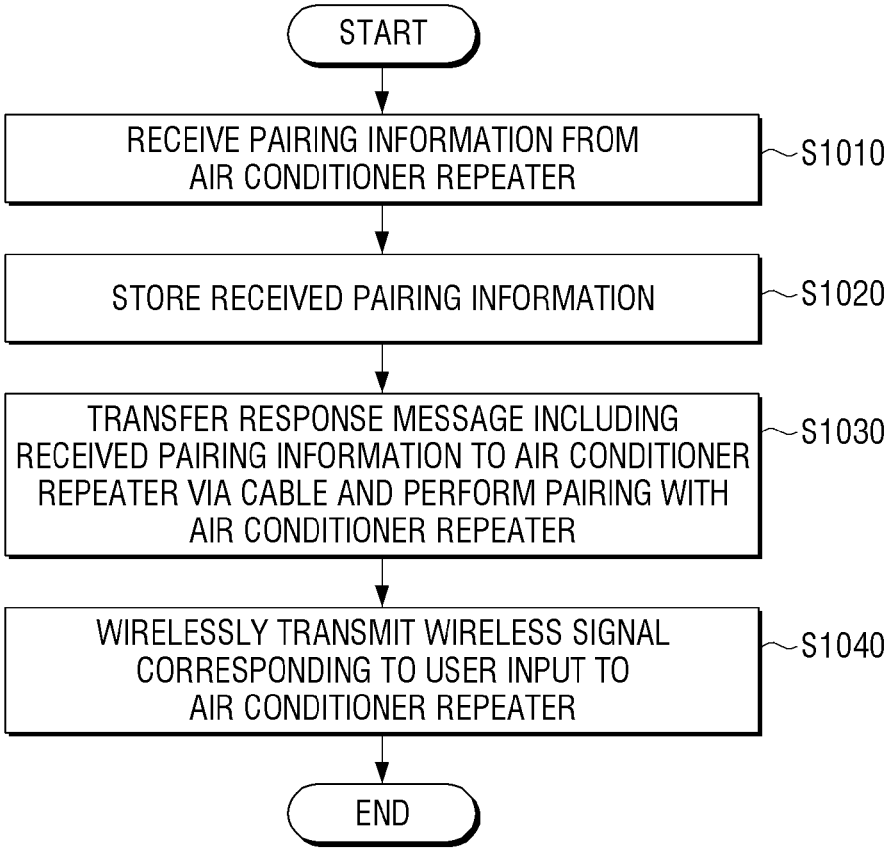

AIR-CONDITIONER REPEATER, AIR-CONDITIONER SYSTEM AND A CONTROL METHOD THEREOF

TECHNICAL FIELD

The present disclosure relates generally to an air conditioner, an air conditioner repeater for repeating a remote controller, an air conditioner system comprising the same, and a control method thereof.

BACKGROUND ART

As people's living standards have improved, home appliances such as air conditioners have become essential to life. The user could control the operation of the air conditioner by using the remote controller.

In related art, an IR remote controller was used. In the case of an obstacle such as a wall between the remote controller and the air conditioner, it was difficult to control the IR remote controller normally.

In recent years, more than one air conditioner has been provided for one household or one group. If a remote controller for controlling each of a plurality of air conditioners is separately provided, the management thereof may be inconvenient.

Accordingly, a need has arisen for a technique capable of controlling a plurality of air conditioners with a single remote controller. In this case, if the related-art IR remote controller is used as it is, there is a problem that the user who wants to control the air conditioner has to move to a position where there is no obstacle between the user and the remote controller.

In consideration of such a problem, a remote controller capable of controlling an air conditioner by a wireless communication method other than IR has been developed, but there is a problem that security is poor in a wireless communication connection process.

DISCLOSURE OF INVENTION

Technical Problem

One or more example embodiments provide an air conditioner repeater which is capable of being connected with a remote controller in a secure method and effectively controlling an air conditioner, an air conditioner system and a control method thereof.

According to an aspect of an example embodiment, there is provided a method for controlling an air conditioner of an air conditioner repeater, the method comprising: based on a remote controller being connected to the air conditioner repeater via a cable, generating pairing information; transferring the generated pairing information to the remote controller via the cable; based on a response message for the pairing information being received from the remote controller via the cable, performing pairing with the remote controller; and based on the wired connection with the remote controller is released and an air conditioner and the air conditioner repeater are connected via a cable, transferring a wireless signal received from the remote controller through a Bluetooth communication to the air conditioner The method may further include storing the pairing information, while the air conditioner repeater is paired with a predetermined number of remote controllers, based on a new remote controller being connected to the air conditioner repeater via a cable, releasing pairing with a remote controller which is paired first from among the remote controllers, and from among pre-stored pairing information, deleting pairing information for the remote controller for which the pairing is released.

The method may further include counting a time elapsing from a time when the pairing information is transmitted, and based on the response message not being received until a preset time is counted, terminating a paring attempt with the remote controller.

The transferring the pairing information to the remote controller via the cable may include periodically transmitting the pairing information until the preset time is counted.

The method may further include, based on the sired connection being made via the cable, receiving a power supply from the remote controller.

According to an aspect of an example embodiment, there is provided an air conditioner repeater, comprising: a wired interface which is capable of wired cable connection; a communication interface for performing wireless communication; and a processor configured to, based on a remote controller being connected to the wired interface via a cable, generate pairing information and transmit the generated pairing information to the remote controller, and based on a response message for the pairing information being received from the remote controller via the wired interface, performing pairing with the remote controller. The processor may, based on the wired connection with the remote controller being released and an air conditioner and the air conditioner repeater being connected via a cable, transfer a wireless signal transmitted through a Bluetooth communication via the communication interface to the air conditioner using a wired connection.

The air conditioner repeater may further include a storage configured to store the pairing information and the response message. The processor may, while the air conditioner repeater is paired with a predetermined number of remote controllers, based on a new remote controller being connected to the air conditioner repeater via a cable, release pairing with a remote controller which is paired first from among the remote controllers, and from among pairing information stored in the storage, delete pairing information for the remote controller for which the pairing is released.

The air conditioner repeater may further include a counter for counting a time elapsing from a time when the pairing information is generated. The processor may, based on the response message not being received until a preset time is counted, terminate a pairing attempt with the remote controller.

The processor may periodically transmit the pairing information via the wired interface until the preset time is counted.

According to an aspect of an example embodiment, there is provided an air conditioner system, comprising: an air conditioner; a remote controller for controlling an operation of the air conditioner; and an air conditioner repeater for repeating communication between the remote controller and the air conditioner. The air conditioner repeater may, based on the air conditioner repeater being connected to the remote controller via a cable, transmit pairing information to the remote controller. The remote controller may transmit a response message for the pairing information to the air conditioner repeater. The air conditioner repeater and the remote controller may perform pairing based on the pairing information and the response message. After the pairing is completed, based on the wired connection between the air conditioner repeater and the remote controller being released and the air conditioner repeater being connected to the air conditioner via a cable, the air conditioner repeater may transfer a wireless signal received from the remote controller to the air conditioner.

The air conditioner repeater may, while the air conditioner repeater is paired with a predetermined number of a plurality of remote controllers, based on a new remote controller being connected to the air conditioner repeater via a cable, release a Bluetooth communication connection with a remote controller which is paired first from among the remote controllers, and from among pairing information stored in the air conditioner repeater, delete pairing information for the remote controller for which the pairing is released.

The air conditioner repeater may count a time elapsing from a time when the pairing information is transmitted, and based on the response message not being received until a preset time is counted, terminate a paring attempt with the remote controller.

The air conditioner repeater may periodically transmit the pairing information until the preset time is counted.

The air conditioner repeater may, based on the wired connection being made with the remote controller, receive a power supply from the remote controller.

According to the various example embodiments described above, the air conditioner repeater may perform communication while being connected with a remote controller via a cable. Accordingly, the security can be improved and, after connection is made, the air conditioner can be conveniently controlled using a wireless communication method, and thereby the user convenience is enhanced.

Solution to Problem

Advantageous Effects of Invention

BRIEF DESCRIPTION OF DRAWINGS

The above and/or other aspects will become more apparent by reference to example embodiments which are illustrated in the appended drawings. Understanding that these drawings depict only example embodiments and are not therefore to be considered to be limiting of the scope of the disclosure, the principles herein are described and explained with additional specificity and detail via the use of the accompanying drawings, in which:

FIG. 1 is a configuration of an air conditioner system, according to an example embodiment;

FIG. 2 is a diagram provided to explain pairing between an air conditioner repeater and a remote controller, according to an example embodiment;

FIGS. 3 and 4 are block diagrams for describing a configuration of an air conditioner repeater, according to various example embodiments;

FIG. 5 is a diagram illustrating a method for pairing an air conditioner repeater connected to a plurality of remote controllers with a new remote controller;

FIG. 6 is a diagram illustrating a method for pairing a remote controller connected to a plurality of air conditioner repeaters with a new repeater;

FIG. 7 is a diagram illustrating a method for replacing an air conditioner repeater or a remote controller;

FIG. 8 is a block diagram to illustrate a configuration of a remote controller, according to an example embodiment;

FIG. 9 is a flowchart that illustrates a method for controlling an air conditioner, according to an example embodiment; and FIG. 10 is a flowchart illustrating a process of pairing a remote controller with an air conditioner repeater, according to an example embodiment.

BEST MODE FOR CARRYING OUT THE INVENTION

Mode for the Invention

Terms used in the present disclosure are selected as general terminologies currently widely used in consideration of the features of the various example embodiments of the present disclosure, but can be different depending on intention of those skilled in the art, a precedent, appearance of new technologies, and the like. In addition, terms selected by the applicant may be used. In this case, the meaning of the terms will be explained in detail in the corresponding detailed descriptions. Accordingly, the terms used in the description should not necessarily be construed as simple names of the terms, but be defined based on meanings of the terms, overall contents of the present disclosure, and general common senses.

Terms including ordinal numbers such as 'first', 'second', and the like, may be used to describe various components. The ordinal numbers are used in order to distinguish the same or similar elements from one another, and the use of the ordinal number should not be understood as limiting the feature, number and the like of the elements.

The terms used herein are solely intended to explain a specific example embodiment, and not to limit the scope of the present disclosure. It is to be understood that the singular forms "a," "an," and "the" include plural referents unless the context clearly dictates otherwise. Further, when a certain portion is stated as "comprising" or "consisting of" a certain element, unless otherwise stated, this means that the certain portion may include another element, rather than foreclosing the same.

According to example embodiments, a "unit" or "module" refers to a unit that performs at least one function or operation, and may be implemented as hardware or software, or a combination of hardware and software. In addition, a plurality of 'modules' or a plurality of 'units' may be integrated into at least one module and may be realized as at least one processor except for 'modules' or 'units' that should be realized in a specific hardware.

The above and other aspects of the present disclosure will become more apparent by describing in detail exemplary embodiments thereof with reference to the accompanying drawings. However, exemplary embodiments may be realized in a variety of different configurations, and not limited to descriptions provided herein. Further, those that are irrelevant with the description are omitted so as to describe exemplary embodiments more clearly, and similar drawing reference numerals are used for the similar elements throughout the description.

Hereinafter, various example embodiments will be described in greater detail below with reference to the accompanying drawings.

FIG. 1 is a configuration of an air conditioner system, according to an example embodiment.

As illustrated in FIG. 1, the air conditioner system 1000 includes an air conditioner 300-1 to **300-*n*, an air conditioner repeater 100, and a remote controller 200**. The air conditioner may further include an air conditioner outdoor unit. However, the air conditioner outdoor unit is not directly relevant to the operations described in the various example embodiments and thus, descriptions of the air conditioner outdoor unit will be omitted herein.

In FIG. 1, the air conditioner 300-1 to **300-*n* refers to an air conditioner indoor unit for emits cold air. Only one air conditioner may be used, but FIG. 1 illustrates the case where a plurality of are included. In addition, FIG. 1 illustrates an air conditioner system including a plurality of air conditioner 300-1 to 300-*n* installable on the ceiling, but the example is not limited thereto. In other words, the air conditioner may be implemented as a wall-mounted indoor unit or a stand indoor unit. In addition, the air conditioner system 1000** may include only one air conditioner.

The air conditioner repeater 100 is an apparatus for repeating communication between the air conditioner 300-1 to **300-*n* and the remote controller 200. The air conditioner repeater 100 may be connected to the air conditioner 300-1 to 300-*n* via a cable, and transmit various signals received from the remote controller 200 to the air conditioner 300. In addition, when various signals or information are received from the air conditioners 300-1 to 300-*n*, the received signals or information may be transmitted to the remote controller 200**.

The air conditioner repeater 100 may be attached to a side of one air conditioner from among one or more air conditioners 300-1 to **300-*n*, and may also be attached to a wall surface to which the air conditioner 300-1 to 300-*n*** are attached.

The remote controller 200 is configured to control the air conditioner 300-1 to **300-*n***.

The remote controller 200 may receive a command for controlling the air conditioners 300-1 to **300-*n*, and transmit the corresponding wireless signal to the repeater 100. In addition, the remote controller 200 may receive status information of the air conditioner 300-1 to 300-*n* from the repeater 100**.

The remote controller 200 and the repeater 100 may perform wireless communication with each other. The wireless communication method may include a Wi-Fi, Zigbee, NFC, RFID, Wibro, Bluetooth, and the like.

The remote controller 200 may be implemented as an exclusive remote controller which is provided to control overall operations of the air conditioner system, but is not limited thereto. For example, in the case where a remote controller application is installed on a terminal, such as a mobile phone, tablet personal computer (PC), PC, laptop PC, and the like having a wireless communication function, the terminal may be operated as a remote controller.

In addition, the remote controller 200 may further include a display to display information or signals transmitted or received to/from the air conditioner repeater 100.

FIG. 1 illustrates one remote controller 200, but a plurality of remote controllers which are capable of performing wireless communication with the repeater may be provided.

As described above, the air conditioner repeater 100 may repeat communication between the air conditioners 300-1 to **300-*n* and the remote controller 200. To this end, it is necessary to connect a communication session between the air conditioner repeater 100 and the remote controller 200. For example, in the case where communication is performed through a Bluetooth communication, it is necessary to perform a Bluetooth pairing between the air conditioner repeater 100 and the remote controller 200**.

The Bluetooth pairing may be performed through a wired interface. In detail, an installation engineer or user who installs the air conditioner system 1000 may connect the air conditioner repeater 100 and the remote controller via a cable. Cables of various standards may be used, but, for example, a USB cable may be used.

When the remote controller 200 and the air conditioner repeater 100 are connected to a wireless communication session via a cable, the remote controller 200 and the air conditioner repeater 100 may communicate with each other via the wireless communication session. The air conditioner repeater 100 may be separated from the remote controller 200 and then, connected to each of the air conditioners via a cable. When a control signal is wirelessly received from the remote controller 200, the air conditioner repeater 100 may transfer the received control signal to each of the air conditioner via a cable. The air conditioners may perform an operation corresponding to the transferred control signal. In detail, various operations such as turn-on, turn-off, adjustment of setting temperature, switching of modes, timer setting, and the like may be performed.

As described above, the air conditioner repeater 100 and the remote controller 200 may be connected to the session in various wireless communication methods, but an example embodiment in which they are connected in a Bluetooth method will be described below.

FIG. 2 is a diagram specifically illustrating a pairing process between an air conditioner repeater and a remote controller, according to an example embodiment.

In an example embodiment, an air conditioner repeater 100 may be, before being connected to the air conditioner 300 via a cable, connected to the remote controller 200 via a cable and perform pairing to perform a Bluetooth communication.

Bluetooth is a low-power wireless connection to support voice and data communication between various devices at a distance within from a minimum of 10 meters (in the case of version 1.0) to a maximum of 240 meters (in the case of version 5.0), and is one of near=field wireless communication technologies.

A Bluetooth system may provide one-to-one connection or one-to-many connection. In the one-to-many connection, a communication channel is shared by a plurality of Bluetooth devices and used. In this regard, two or more Bluetooth devices may share the same communication channel and form a piconet. Any one of a plurality of Bluetooth devices may serve as a master and the other devices may perform as slaves.

As described above, since the Bluetooth devices belonging to the piconet transmit and receive data through the wireless interface, security measures are required. To this end, a connection between the Bluetooth devices is subjected to a pairing process for authentication and for generating a link key.

In the present disclosure, the pairing refers to a prior procedure that is proceeded for connection between two devices (e.g., a remote controller and an air conditioner repeater) performing Bluetooth wireless communication and to encrypt data transceived between the two devices.

In the present disclosure, the air conditioner repeater 100 may perform pairing with the remote controller 200 through an out-of-band method. The out-of-band method is a method using an interface other than Bluetooth to exchange pairing information. The air conditioner repeater 100 and the remote controller 200 may be an interface to exchange pairing information and may use a Universal Asynchronous Receiver/Transmitter (UART) wired communication.

When the air conditioner repeater 100 and the remote controller 200 are connected via a cable, the air conditioner repeater 100 generates pairing information. The pairing information is information required to perform pairing between the air conditioner repeater 100 and the remote controller 200. The pairing information may differ depending on the version or specification of Bluetooth. In an example embodiment of the present disclosure, the pairing information may be sixteen numbers from zero to 255. One or more remote controller 200 may be wirelessly connected to one air conditioner repeater 100. The pairing information sent to each remote controller 200 by the air conditioner repeater 100 may be different from each other.

The air conditioner repeater 100 may transmit the generated pairing information to the remote controller 200. In this regard, the air conditioner repeater 100 may periodically transmit pairing information until the remote controller 200 receives pairing information.

When the pairing information is received from the air conditioner repeater 100, the remote controller 200 may transmit a response message for the received pairing information to the air conditioner repeater 100. In this regard, the response message may include pairing information.

When the air conditioner repeater 100 receives pairing information from the remote controller 200, the air conditioner repeater 100 and the remote controller 200 may perform Bluetooth pairing based on the pairing information and the response message.

In detail, the air conditioner repeater 100 may request pairing to the remote controller 200, and the remote controller 200 which received the pairing request may transmit a response message that includes product information including a Bluetooth device address (BD_ADDR), a device name, and profile information to the air conditioner repeater 100.

Thereafter, the air conditioner repeater 100 may transmit a random number capable of initializing an encryption engine. The air conditioner repeater 100 and the remote controller 200 may initialize an encryption engine by using the same random number. The remote controller 200 may transmit a response message for the reception of the random number to the air conditioner repeater 100.

The air conditioner repeater 100 which has received a response message from the remote controller 200 may transmit a message including another random number to the remote controller 200, and the remote controller 200 receiving this message may encrypt the message using an encryption engine and then transmit the encrypted message to the air conditioner repeater 100.

The air conditioner repeater 100 which has received a message from the remote controller 200 may encrypt a random number included in the received message by using its own encryption engine, and compare the encrypted message with the message received from the remote controller 200.

When it is identified that the two messages are identical to each other, the air conditioner repeater 100 and the remote controller 200 may exchange a message including a combination key for generating a link key with each other, and generate a link key based on the exchanged message.

At the time of connection thereafter, the air conditioner repeater 100 and the remote controller 200 which have generated a link key may be interconnected with each other using the generated link key without the pairing process.

In the process described above, the air conditioner repeater 100 and the remote controller 200 may include identification information, such as pairing information and the like, in the message exchanged therebetween.

The Bluetooth pairing procedure described above is only an example, and may differ depending on the Bluetooth specification or version.

Once the Bluetooth pairing between the air conditioner repeater 100 and the remote controller 200 is completed, the air conditioner repeater 100 may perform wireless communication with the remote controller 200. For example, when a system installation engineer or a user releases wired connection between the air conditioner repeater 100 and the remote controller 200 and connects the air conditioner repeater 100 to the air conditioners 300-1 to **300-*n*, thereafter, the air conditioner repeater 100 and the remote controller 200** may perform communication via a wireless communication method.

FIG. 3 is a configuration of an air conditioner repeater, according to an example embodiment. The air conditioner repeater 100 may include a processor 110, a wired interface 120, and a communication interface 130.

The wired interface 120 may refer to a portion which can be connected to an external device, such as a remote controller 200, an air conditioner 300, and the like, via a cable. The wired interface 120 may include at least one wired cable port. If the air conditioner repeater is provided with one wired cable port, the air conditioner repeater may be alternately connected to one of the air conditioner and the remote controller via a cable. On the other hand, if the air conditioner repeater is provided with a plurality of wired cable ports, even when the air conditioner repeater is connected to the air conditioner via a cable, the air conditioner repeater may be connected to the remote controller via a cable and perform pairing.

The communication interface 130 refers to an element for performing communication via a wireless communication method. As described above, when a Bluetooth method is applied, the communication interface 130 may be implemented as a Bluetooth communication module.

The processor 110 is an element for controlling overall operations of the air conditioner repeater. In detail, the processor 110 may control various hardware or software elements included in the air conditioner repeater, and perform various data processing and operations. Further, the processor 130 may load and process a command or data received from at least one of the other components to a volatile memory and store diverse data in a memory. For this operation, the processor 110 may be realized a dedicated processor for performing functions (for example, embedded processor) or a generic-purpose processor for performing functions by running one or more software programs stored in a memory device (for example, a CPU or an application processor).

When the air conditioner repeater 100 is connected to the remote controller 200 via a cable, the processor 110 may perform pairing as described above. In this regard, the processor 110 may perform pairing according to a software (S/W) pairing algorithm.

In detail, the processor 100 may transmit pairing information to the remote controller 200 via a wired interface 120. When the remote controller 200 transmits a response message via a cable, the processor 110 may receive the response message via the wired interface 120. The processor 110 may perform Bluetooth pairing based on the pairing information and the response message. When the Bluetooth pairing is completed, the processor 110 may wirelessly connected to the remote controller 200 via the communication interface 130. The specific pairing process is described in FIG. 2, the duplicate explanation thereof will be omitted.

When the Bluetooth pairing between the air conditioner repeater 100 and the remote controller 200 is completed and the air conditioner repeater 100 is connected to each of the air conditioners 300-1 to **300-*n*, the processor 110 may perform wired communication with the air conditioners 300-1 to 300-*n* via the wired interface 120, and controls the communication interface 130 and performs wireless communication with the remote controller 200**.

That is, when a wired signal is received from the air conditioners 300-1 to **300-*n*, the processor 110 may wirelessly transmit the received wired signal to the remote controller 200, and when a wireless signal is received from the remote controller 200, transfer the received wireless signal to the air conditioners 300-1 to 300-*n*. In this regard, the processor 110 may convert the wired signal received from the air conditioners 300-1 to 300-*n* into a wireless signal, and convert the wireless signal received from the remote controller 200** into a wired signal.

The processor 110 may receive various information from each of the air conditioners 300-1 to **300-*n* via the wired interface 120. As an example, state information of the air conditioner 300-1 to 300-*n*, such as product information of the air conditioner bodies, identification information of the air conditioner bodies, whether the air conditioner are turned on or off, and an operation state of the air conditioner may be received. The processor 100 may use the received information in itself, and transmit the received information to the remote controller 200**.

When the processor 100 is connected to the air conditioner 300-1 to **300-*n* via the wired interface 120, when a remote control signal is received via the communication interface 130, the processor 110 may transmit the remote control signal to at least one of the air conditioners 300-1 to 300-*n* via the wired interface 120. The control of the air conditioners 300-1 to 300-*n*** may be implemented in various manners according to example embodiments.

For example, the processor 110 may analyze a remote control signal, detect identification of an air conditioner to be controlled by the user, and then determine which air conditioner from among the plurality of air conditioners 300-1 to **300-*n* is to be transmit the remote control signal based on the detected identification information. That is, when the user presses a button for controlling n-th air conditioner 300-*n* from among the plurality of air conditioners 300-1 to 300-*n*, identification information corresponding to the n-th air conditioner may be included in the remote control signal. The processor 110** may transfer the remote control signal to the n-th air conditioner.

As another example, the processor 110 may transmit the received remote control signal itself to the entire air conditioners 300-1 to **300-*n*. In this regard, each of the air conditioners 300-1 to 300-*n*** may identify identification information included in the received remote control signal and determine whether it is to perform an operation.

According to another example embodiment, the air conditioner repeater 100 may connect a wireless communication session with a plurality of remote controllers. In this regard, it is necessary to pre-store pairing information for a remote controller for which pairing is completed.

FIG. 4 is a configuration of an air conditioner repeater, according to another example embodiment.

Referring to FIG. 4, the air conditioner repeater 100 may include a processor 110, a wired interface 120, a communication interface 130, a timer 140, and a storage 150.

In this regard, the processor 110, wired interface 120 and communication interface 130 illustrated in FIG. 4 may perform the same function as each of the elements illustrated in FIG. 3 and thus, the duplicate description thereof will be omitted.

The timer 140 is an element for counting the time that elapses from the time at which the air conditioner repeater 100 generates pairing information. In this regard, the counter may be implemented as hardware provided inside the air conditioner repeater 100 or may be implemented as a counter program executed by the processor 110.

When the pairing information is generated, the processor 110 may control the timer 140 to initiate counting. Until the time counted in the timer 140 reaches a preset time, the processor 110 may periodically transfer the pairing information via the wired interface 120.

When a response message is not received from the remote controller 200 until a predetermined time elapses, the processor 110 may terminate a pairing attempt with the remote controller. When a speaker (not illustrated) or a display (not illustrated) is provided in the air conditioner repeater 100, the processor 110 may output a notification sound or notification message informing that the pairing has been failed.

The storage 150 is an element for storing various programs and data. The storage 150 may be not only implemented as various internal storage media, such as a non-volatile memory, a volatile memory, a flash memory, a hard disk drive (HDD), a solid state drive (SSD), or the like, but also implemented as external storage media, such as an external memory card, a memory stick, and the like.

The storage 150 may store identification information of the air conditioners 300-1 to **300-*n*. As described above, a wireless signal received from the remote controller 200 may be a signal for a particular air conditioner from among a plurality of air conditioners 300-1 to 300-*n*. To appropriately transfer the signal to the particular target air conditioner, it is necessary that the processor 110 identifies the air conditioners 300-1 to 300-*n*. Accordingly, the identification information may be additionally stored in the storage 150 and the air conditioners 300-1 to 300-*n*** may be identified.

The identification information of the air conditioner 300 may be transferred to the air conditioner repeater 100 when the air conditioner 100 and the air conditioner 300 are connected via a cable, but the example is not limited thereto. That is, the identification information of the air conditioner 300 connected to the air conditioner 100 may be stored in the manufacturing process of the air conditioner system 1000. In addition, the user may directly input identification information of the air conditioner 300 to the air conditioner repeater 100 after the air conditioner repeater 100 and the air conditioner 300 are connected via a wire.

In addition, the storage 150 may store pairing information. When the pairing is completed, the processor 110 may store the pairing information in the storage 150 and manage the stored pairing information. Accordingly, once the pairing is performed, unless a pairing release operation is performed, a wireless communication connection may be immediately performed even if the remote controller is turned off and turned on again.

As described above, a plurality of remote controllers 200 may be paired with the air conditioner repeater 100. The number of remote controllers that may be paired may be limited. For example, if pairing with four remote controllers 200 is possible, when a new remote controller attempts pairing thereafter, the processor 110 may selectively manage a pairing state.

For example, the processor 110 may delete pairing information of a remote controller of which the time of pairing is the oldest from among the previous remote controllers. FIG. 5 is a diagram illustrating an example method of managing pairing information.

FIG. 5 is a diagram illustrating a method for pairing an air conditioner repeater connected to a plurality of remote controllers with a new remote controller.

FIG. 5 illustrates a case of, in a state that remote controllers 200-1, 200-2 and 200-3 for which pairing with the air conditioner repeater 100 is completed are present, attempting pairing with a new remote controller 200-4. That is, the new remote controller 200-4 is not in a state of being paired with the air conditioner repeater 100 yet.

The number of remote controllers that may be paired with the air conditioner repeater 100 may have been set. FIG. 5 illustrates that it is possible that the air conditioner repeater 100 is capable of pairing with a maximum of three remote controllers 200-1, 200-2 and 200-3. However, this is only an example, and the maximum number of remote controllers that may be paired may differ. In addition, it is common that the number of remote controllers 200-1, 200-2 and 200-3 to be paired is less than the number of air conditioners connected to the air conditioner repeater 100 via a cable, but the example is not limited thereto.

In a state that the maximum number of remote controllers have been paired, the user who wishes to use a new remote controller 200-4 may connect the new remote controller 200-4 to the air conditioner repeater 100 via a cable.

In this regard, the processor may release pairing with one of the previous remote controllers according to a pairing management policy.

For example, the processor 110 may release pairing with a remote controller 200-1 which was paired first from among the paired remote controllers 200-1, 200-2 and 200-3. That is, in FIG. 6, the connection ⓐ may be released. In addition, the processor 110 may delete pairing information corresponding to the remote controller 200-1 for which the pairing has been released from among the pairing information stored in the storage 150.

As another example, the processor 110 may release pairing with a remote controller of which communication frequency is the lowest in consideration of a Bluetooth wireless communication history with the air conditioner repeater 100 and the like.

As another example, the processor 110 may select a remote controller having the weakest wireless remote control signal in consideration of an intensity of the Bluetooth wireless communication and the like. Alternatively, the processor 110 may select a remote controller having the oldest manufacture date and release pairing in consideration of device information of a remote controller received in the pairing process and the like.

When pairing with one of the previous remote controllers is released, the processor 110 may perform pairing with a new remote controller 200-4 and connect a wireless communication session (b).

In the description above, a plurality of remote controllers are connected to one air conditioner repeater. However, reversely, one remote controller may be connected to a plurality of repeaters.

FIG. 6 is a diagram illustrating a method for pairing a remote controller connected to a plurality of air conditioner repeaters with a new repeater.

FIG. 6 illustrates a situation where, in a state that the remote controller 200 has previously been paired with a plurality of air conditioner repeaters 100-1 and 100-2, the remote controller 200 is to perform pairing with another repeater 100-3.

The number of air conditioner repeaters that may be paired with the remote controller 200 may have been set. FIG. 5 illustrates that it is possible that the remote controller 200 is capable of pairing with a maximum of two air conditioner repeaters 100-1 and 100-2. However, this is only an example, and the maximum number of air conditioner repeaters that may be paired may differ.

In a state of being paired with the maximum number of air conditioner repeaters 100-1 and 100-2, to perform pairing with a new repeater 100-3, the remote controller 200 may release pairing with the air conditioner repeater 100-1 which was paired first from among the paired air conditioner repeaters 100-1 and 100-2. That is, in FIG. 6, the connection ⓐ may be released. In addition, pairing information corresponding to the remote controller 100-1 for which the pairing has been released from among the pairing information stored in the remote controller 200 may be deleted.

In this regard, releasing connection with the air conditioner repeater 100-1 which was paired first is only an example, and it is possible to select an air conditioner repeater 100-1 for which the pairing connection is to be released in consideration of other elements.

For example, an air conditioner repeater having the lowest communication frequency may be selected in consideration of the Bluetooth communication history with the remote controller 200 and the like. An air conditioner repeater having the weakest wireless signal may be selected in consideration of an intensity of the Bluetooth communication signal and the like. An air conditioner repeater having the oldest manufacture date may be selected in consideration of device information of the air conditioner repeater received in the pairing process.

Meanwhile, this is an example of a case where one remote controller 200 is paired with a new repeater 100-3, and when a plurality of remote controllers are paired with the new repeater 100-3, the process described above may be executed for each of the paired remote controllers.

Sometimes, an air conditioner repeater and a remote controller are damaged or broken in a usage process and replacement is necessary. At the time of replacement, it is necessary that pairing with a new device is performed.

FIG. 7 is a diagram illustrating a method for replacing an air conditioner repeater or a remote controller.

In a state that one or more remote controllers 200 are Bluetooth-paired with the air conditioner repeater 100, there may be cases where a remote controller **200-*k*** is replaced with a new remote controller due to a remote controller failure or a user's change of mind.

In this regard, a wired connection with the air conditioner repeater 100 and the air conditioners 300-1 to **300-*n* may be released, and the air conditioner repeater 100 may be detached from the air conditioners 300-1 to 300-*n***.

In addition, a new remote controller may be connected to the air conditioner repeater 100 via a cable, and as illustrated in FIG. 2, a Bluetooth pairing procedure is proceeded.

If a plurality of remote controllers are paired, the air conditioner repeater 100 may not recognize the remote controller **200-*k* with which the remote controller 200-*k* is replaced. In this regard, the air conditioner repeater may release connection with all of the plurality of remote controllers 200-1 to 200-*n*** which are paired, and delete the entire pairing information.

The user may connect each of remote controllers to be used including a new remote controller with which the remote controller **200-*k*** is to be replaced via a cable, and perform pairing.

In FIG. 7, it is illustrated that one remote controller is replaced in a state that one air conditioner repeater and a plurality of remote controllers are paired, but even when one remote controller and a plurality of air conditioner repeaters are paired, one air conditioner repeater may be replaced in the same manner.

FIG. 8 is a block diagram to illustrate a configuration of a remote controller, according to an example embodiment.

The remote controller 200 may include a processor 210, a wired interface 220, a communication interface 230, a display 240, a power supply 250, a storage 260, and an input interface 270.

The wired interface 220 is an element for performing wired communication with the air conditioner repeater 100. When the air conditioner repeater 100 is connected to the remote controller 200 via a cable, the processor 210 may receive pairing information from the air conditioner repeater 100 via the wired interface 220, and transfer a response message.

The communication interface 230 is an element for performing wireless communication with the air conditioner repeater 100. In detail, when a wired connection between the air conditioner repeater 100 and the remote controller 200 is released, the communication interface 230 may transmit and receive a wireless signal while performing Bluetooth communication with the air conditioner repeater 100.

In this regard, a wireless signal sent to the air conditioner repeater 100 by the communication interface 230 may include a control signal for controlling the air conditioners 300-1 to **300-*n*. In this regard, the communication interface 230 may transmit a control signal for a particular air conditioner from among one or more air conditioners 300-1 to 300-*n***.

The processor 230 may control the overall operations of the remote controller 200. For example, when the remote controller 200 is connected to the air conditioner repeater 100 via a cable, when pairing information is received from the air conditioner repeater 100, a response message for the received pairing information may be transmitted to the air conditioner repeater 100. In addition, when the connection between the remote controller 200 and the air conditioner repeater 100 is released, the processor 210 may control the communication interface 230 and perform wireless communication.

In the state that the remote controller 200 is in a state of being paired with the maximum number of air conditioner repeaters 100 that is pairable, when a new repeater is connected to the remote controller 200 via a cable, the processor 210 may determine an air conditioner repeater 100 for which pairing with the remote controller 200 is to be released, release pairing with the corresponding air conditioner repeater 100, and delete related pairing information.

In addition, when an air conditioner repeater 100 paired with the remote controller 200 is replaced, the processor 210 may release pairing with the air conditioner repeater to be replaced, delete pairing information related thereto, and then perform pairing with a new air conditioner repeater. In this regard, the processor 210 may generate pairing information for the new air conditioner repeater, and store the generated pairing information in the storage 260.

The display 120 may display various UIs and information under the control of the processor 210. The processor 210 may display various information and notification signals received via the communication interface 230 or the wired interface 220 through the display 240. For example, in the state that the remote controller 200 is connected to the air conditioner repeater 100 via a cable, a message informing that pairing is performed and the like may be displayed. In addition, in a case in which the remote controller 200 performs wireless communication with the air conditioner repeater 100, state information of the air conditioner 300 received from the air conditioner repeater 100, a wireless remote control signal transmitted to the air conditioner repeater 100 and the like may be displayed.

The power supply 250 is an element for supplying power to the remote controller 200.

When the remote controller 200 is connected to the air conditioner repeater 100 via a cable, the power supply 250 may supply power to the air conditioner repeater 100 as well as the remote controller 200. However, this is only an example, and a power supply may be included in the air conditioner repeater 100, and directly receive power supply without the air conditioner repeater 100 being connected to an external device, such as the air conditioner 300, the remote controller 200, and the like.

The storage 260 is an element for storing pairing information and configuration information of the air conditioner 300. In detail, when the remote controller 200 and the air conditioner repeater 100 are connected via a cable and perform pairing, the storage 260 may store pairing information received from the air conditioner repeater 100. In addition, after pairing is completed, after the wired connection between the remote controller 200 and the air conditioner repeater 100 is released, information of the air conditioners 300-1 to **300-*n* received from the air conditioner repeater 100** may be stored.

The remote controller 200 may be paired with a plurality of air conditioner repeaters. In this regard, pairing information, which are different from each other, corresponding to each of the plurality of air conditioner repeaters may be stored in the storage 260.

In addition, the storage 260 may store a command or data which is received from, or generated by, the processor 210 or other elements (e.g., the wired interface 220, the communication interface 230, the display 240, the power supply 250, the storage 260, the input interface 270, and the like).

The input interface 270 is an element for receiving various user inputs for controlling the remote controller 200 and transferring the received user inputs to the processor 210.

The input interface 270 may receive various user inputs for controlling functions of the remote controller 200. For example, a user input for controlling functions of an air conditioner, such as power on/off, desired temperature setting, air flow adjustment, wind direction adjustment, and the like, may be received. In this regard, the processor 210 may control the other elements to execute various functions corresponding to a user input received via the input interface 270.

In this regard, the input interface 270 may be implemented as an input panel provided in the remote controller 200. In this regard, the input panel may implemented by using a touch pad, a key pad provided with various function keys, number keys, special keys, character keys, etc., or a touch screen.

FIG. 9 is a flowchart of a method for controlling an air conditioner, according to an example embodiment.

First, when the air conditioner repeater 100 is connected to the remote controller 200 via a cable, pairing information may be received, at operation S910.

The generated pairing information may be stored in an air conditioner repeater, at operation S920.

In addition, the air conditioner repeater 100 may transfer the stored pairing information to the remote controller 200 via a cable, at operation S930. In this regard, the air conditioner repeater 100 may periodically transfer the stored pairing information for a preset time.

In the case where a response is not received from the remote controller 200 for a preset time, the transmission of pairing information may be suspended and the pairing procedure may be terminated.

In the case where a response message for the pairing information is received from the remote controller 200, the air conditioner 100 may perform pairing with the remote controller 200, at operation S950.

Thereafter, when pairing is completed, the air conditioner repeater 100 may release wired connection with the remote controller, and transfer a wireless signal received from the remote controller to the air conditioners 300-1 to **300-*n*, at operation S960**.

FIG. 10 is a flowchart illustrating a process of pairing a remote controller with an air conditioner repeater, according to an example embodiment.

When the remote controller 200 is connected to the air conditioner repeater 100 via a cable, pairing information with the air conditioner may be received from the air conditioner repeater 100, at operation S1010.

In addition, the remote controller 200 stores the received pairing information, at operation S1020.

Thereafter, the remote controller 200 may transfer a response message for the received pairing information to the air conditioner repeater 100 via a cable, and perform pairing with the air conditioner repeater 100, at operation S1030.

When pairing is completed and a wired connection between the remote controller 200 and the air conditioner repeater 100 is released, the remote controller 200 may wirelessly transmit a wireless remote control signal corresponding to a user input to the air conditioner repeater 100, at operation S1040.

As described above, according to the various example embodiments, pairing is performed while the air conditioner repeater and the remote controller are connected via a cable. Accordingly, the risk of the pairing information being hacked can be significantly reduced. After pairing is completed, the user can wirelessly control the air conditioner system by using a remote controller. Accordingly, the user convenience can be increased.

In the various example embodiments described above, the operations of a repeater for controlling an air conditioner system and a remote controller are described, but it is not always the case that they are applicable to air conditioning systems only. For example, even in a home system where a plurality of home appliances are present, when an air conditioner system is to be controlled by one integrated remote controller, a repeater may be installed in each room. In this regard, pairing between the repeater and the remote controller may be performed using a wired communication method as described in the various example embodiments.

The foregoing embodiments and advantages are merely exemplary and are not to be construed as limiting the present disclosure. Also, the description of the example embodiments is intended to be illustrative, and not to limit the scope of the claims, and many alternatives, modifications, and variations will be apparent to persons having ordinary skill in the art. In addition, many alternatives, modifications, and variations will be apparent to persons having ordinary skill in the art.

Therefore, the present disclosure should be construed as including all the changes, equivalents, and substitutions included in the spirit and scope of the present disclosure.

INDUSTRIAL APPLICABILITY

Sequence Listing Free Text

The invention claimed is:

1. An air conditioner controlling method of an air conditioner repeater, the method comprising:

based on a remote controller being connected to the air conditioner repeater via a first cable, generating pairing information;

transferring the generated pairing information to the remote controller via the first cable;

based on a response message for the pairing information being received from the remote controller via the first cable, performing pairing with the remote controller;

based on a wired connection with the remote controller being released and a plurality of air conditioners and the air conditioner repeater being connected via a second cable, transferring a wireless signal, which is received from the remote controller through a Bluetooth communication, to the plurality of air conditioners through the second cable connected with the plurality of air conditioners; and while the air conditioner repeater is paired with a predetermined number of remote controllers, based on a new remote controller being connected to the air conditioner repeater via a third cable, releasing pairing with a remote controller having a weakest wireless remote control signal or having an oldest manufacture date from among the remote controllers, wherein the performing pairing with the remote controller comprises:

transmitting a random number for initializing an encryption engine, initializing the encryption engine by using the random number, and based on a response message for reception of the random number from the remote controller initializing the encryption engine of the remote controller by using the random number, performing pairing with the remote controller using the encryption engine, wherein the transferring of the wireless signal comprises:

obtaining an identification information included in the received wireless signal, and transferring the wireless signal to at least one of the plurality of air conditioners corresponding to the obtained identification information, wherein the pairing information comprises sixteen numbers from 0 to 255.

2. The air conditioner controlling method of the air conditioner repeater as claimed in claim 1, further comprising:

storing the pairing information; and from among pre-stored pairing information, deleting pairing information for the remote controller for which the pairing is released.

3. The air conditioner controlling method of the air conditioner repeater as claimed in claim 1, further comprising:

counting a time elapsing from a time when the pairing information is transmitted; and based on the response message not being received until a preset time is counted, terminating a paring attempt with the remote controller.

4. The air conditioner controlling method of the air conditioner repeater as claimed in claim 3, wherein the transferring the pairing information to the remote controller via the first cable comprises periodically transmitting the pairing information until the preset time is counted.

5. The air conditioner controlling method of the air conditioner repeater as claimed in claim 1, further comprising:

receiving a power supply from the remote controller via the first cable.

6. An air conditioner repeater, comprising:

a wired interface which is capable of wired cable connection;

a communication interface for performing wireless communication; and a processor configured to:

based on a remote controller being connected to the wired interface via a first cable, generate pairing information and transmit the generated pairing information to the remote controller, and based on a response message for the pairing information being received from the remote controller via the wired interface, perform pairing with the remote controller, based on the wired connection with the remote controller being released and a plurality of air conditioners and the air conditioner repeater being connected via a second cable, transfer a wireless signal, which is received from the remote controller through a Bluetooth communication, via the communication interface to the plurality of air conditioners using a wired connection, and while the air conditioner repeater is paired with a predetermined number of remote controllers, based on a new remote controller being connected to the air conditioner repeater via a third cable, release pairing with a remote controller having a weakest wireless remote control signal or having an oldest manufacture date from among the remote controllers, and wherein the processor is further configured to:

transmit a random number for initializing an encryption engine through a wired interface, initialize the encryption engine by using the random number, and based on a response message for reception of the random number from the remote controller initialize the encryption engine of the remote controller by using the random number, perform pairing with the remote controller using the encryption engine, wherein the processor is further configured to:

obtain an identification information included in the received wireless signal, and transfer the wireless signal to at least one of the plurality of air conditioners corresponding to the obtained identification information, and wherein the pairing information comprises sixteen numbers from 0 to 255.

7. The air conditioner repeater as claimed in claim 6, further comprising:

a storage configured to store the pairing information and the response message, wherein the processor, from among pairing information stored in the storage, deletes pairing information for the remote controller for which the pairing is released.

8. The air conditioner repeater as claimed in claim 6, further comprising:

a counter for counting a time elapsing from a time when the pairing information is generated, wherein the processor, based on the response message not being received until a preset time is counted, terminates a pairing attempt with the remote controller.

9. The air conditioner repeater as claimed in claim 8, wherein the processor periodically transmits the pairing information via the wired interface until the preset time is counted.

10. An air conditioner system, comprising:

a plurality of air conditioners;

a remote controller for controlling an operation of the plurality of air conditioners; and an air conditioner repeater for repeating communication between the remote controller and the plurality of air conditioners, wherein the air conditioner repeater, based on the air conditioner repeater being connected to the remote controller via a first cable, transmits pairing information to the remote controller, wherein the remote controller transmits a response message for the pairing information to the air conditioner repeater, wherein the air conditioner repeater and the remote controller perform pairing based on the pairing information and the response message, wherein after the pairing is completed, based on a wired connection between the air conditioner repeater and the remote controller being released and the air conditioner repeater being connected to the plurality of air conditioners via a second cable, the air conditioner repeater transfers a wireless signal, which is received from the remote controller, to the plurality of air conditioners through the second cable connected with the plurality of air conditioners, wherein the air conditioner repeater, while the air conditioner repeater is paired with a predetermined number of a plurality of remote controllers, based on a new remote controller being connected to the air conditioner repeater via a third cable, releases a Bluetooth communication connection with a remote controller having a weakest wireless remote control signal or having an oldest manufacture date from among the remote controllers, wherein the air conditioner repeater transmits a random number for initializing an encryption engine through a wired interface, initializes the encryption engine by using the random number, and based on a response message for reception of the random number from the remote controller initializing the encryption engine of the remote controller by using the random number, performs pairing with the remote controller using the encryption engine, wherein the air conditioner repeater obtains an identification information included in the received wireless signal, and transfers the wireless signal to at least one of the plurality of air conditioners corresponding to the obtained identification information, and wherein the pairing information comprises sixteen numbers from 0 to 255.

11. The air conditioner system as claimed in claim 10, wherein the air conditioner repeater, from among pairing information stored in the air conditioner repeater, deletes pairing information for the remote controller for which the pairing is released.

12. The air conditioner system as claimed in claim 10, wherein the air conditioner repeater counts a time elapsing from a time when the pairing information is transmitted, and based on the response message not being received until a preset time is counted, terminates a paring attempt with the remote controller.

13. The air conditioner system as claimed in claim 12, wherein the air conditioner repeater periodically transmits the pairing information until the preset time is counted.

14. The air conditioner system as claimed in claim 10, wherein the air conditioner repeater, based on the wired connection being made with the remote controller, receives a power supply from the remote controller.

* * * * *